United States Patent [19]

Schramm et al.

[11] Patent Number: 5,009,773

[45] Date of Patent: Apr. 23, 1991

[54] MONITORING SURFACTANT CONTENT TO CONTROL HOT WATER PROCESS FOR TAR SAND

[75] Inventors: Laurier L. Schramm; Russell G. Smith, both of Edmonton, Canada

[73] Assignees: Alberta Energy Company Ltd.; Canadian Occidental Petroleum Ltd.; Esso Resources Canada Limited, all of Alberta, ; part interest to each; Gulf Canada Limited, Ontario; Her Majesty the Queen in right of the Province of Alberta, Alberta; HBOG-Oil Sands Limited Partnership, Alberta; PanCanadian Petroleum Limited, Alberta; Petro-Canada Inc., Alberta, all of Canada

[21] Appl. No.: 1,258

[22] Filed: Jan. 7, 1987

[51] Int. Cl.[5] ..... C10E 1/04

[52] U.S. Cl. ..... 208/391

[58] Field of Search ..... 208/391, DIG. 1

[56] References Cited

U.S. PATENT DOCUMENTS

| | | | |
|---|---|---|---|
| 4,201,656 | 5/1960 | Sanford | 208/391 |
| 4,425,227 | 1/1984 | Smith | 208/391 X |
| 4,462,892 | 7/1984 | Schramm et al. | 208/391 |

OTHER PUBLICATIONS

"The Influence of Natural Surfactant Concentration on the Hot Water Process for Recovering Bitumen from the Athabasca Oil Sands", AOSTRA J. Research, 1 (1984), 5.

"A Surface-Tension Method for the Determination of Anionic Surfactants in Hot Water Processing of Athabasca Oil Sands", Colloids and Surfaces, 11 (1984), 247-263.

"Processability of Athabasca Tar Sand Using a Batch Extraction Unit: The Role of NaOH", CIM Bulletin, 72 (1979), 164.

*Primary Examiner*—Asok Pal

[57] ABSTRACT

The present invention is based on the following:

(1) that when tar sand is conditioned and diluted in the hot water extraction process, there are two classes of anionic surfactants (originating from carboxylate and sulfonate groups) present in the process water;

(2) that each of these surfactants has the potential to dominantly influence the maximizing of primary froth production by the process;

(3) that it is possible for a particular extraction circuit to determine the critical free surfactant concentration in the process water at which primary froth extraction is maximized for each of the two classes of surfactant;

(4) and that it is possible to determine which of the two classes of surfactant will first (that is, at lowest NaOH addition) dominate the process when a particular tar sand feed is being processed.

The present invention therefore involves:

determining the critical free surfactant concentrations ("$C_{cs}^{O}$" and "$C_{ss}^{O}$") for the circuit for each of the carboxylate and sulfonate classes of surfactants;

monitoring the free surfactant concentrations ("$C_{cs}$" and "$C_{ss}$") in the process water for an ore being processed;

determining which of $C_{cs}^{O}$ and $C_{SS}^{O}$ occurs at a lower NaOH addition;

and then adjusting NaOH addition to the extraction process to bring the first dominating surfactant concentration toward the critical concentration value.

1 Claim, 6 Drawing Sheets

*where $C_{CS}$= concentration of equilibrium free carboxylate surfactant in process water $C_{SS}$= concentration of equilibrium free sulfonate surfactant in process water $C^{\circ}_{CS}$= $C_{CS}$ concentration at which primary froth recovery is a maximum $C^{\circ}_{SS}$= $C_{SS}$ concentration at which primary froth recovery is a maximum

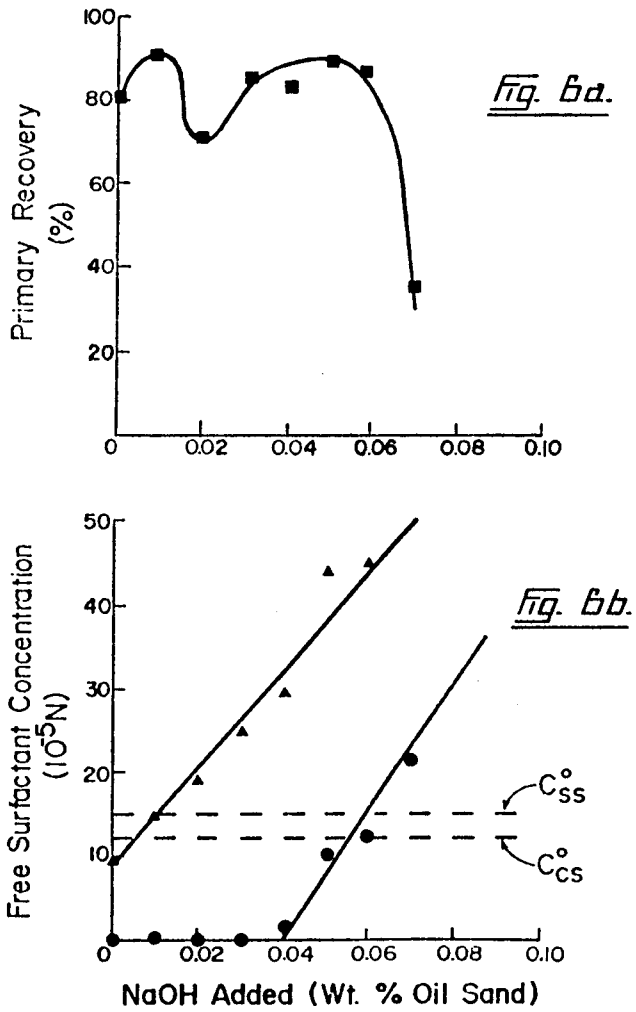
Fig. 6a.
Primary Recovery
(%)
100
80
60
40
20
0
0.02
0.04
0.06
0.08
0.10
Fig. 6b.
Free Surfactant Concentration
($10^{-5}$N)
50
40
30
20
10
$C^o_{SS}$
$C^o_{CS}$
NaOH Added (Wt. % Oil Sand)
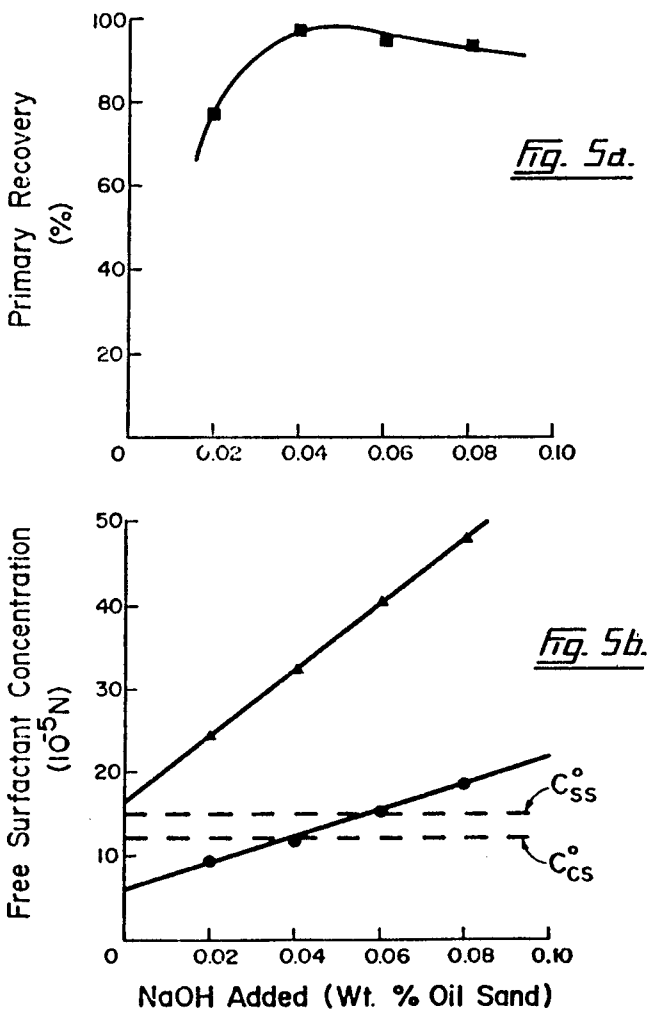
Fig. 5a.
Primary Recovery
(%)
100
80
60
40
20
0
0.02
0.04
0.06
0.08
0.10
Fig. 5b.
Free Surfactant Concentration
($10^{-5}$N)
50
40
30
20
10
$C^o_{SS}$
$C^o_{CS}$
NaOH Added (Wt. % Oil Sand)

Primary Recovery
(%)
100
80
60
40
20
0
0.01
0.02
0.03
0.04
0.05

Free Surfactant Concentration
($10^{-5}$N)
50
40
30
20
10
0
0.01
0.02
0.03
0.04
0.05
NaOH Added (Wt. % Oil Sand)
$C^{o}_{SS}$
$C^{o}_{CS}$ Primary Recovery
(%)
100
80
60
40
20
0
0.01
0.02
0.03
0.04
0.05

Free Surfactant Concentration
($10^{-5}$N)
50
40
30
20
10
0
0.01
0.02
0.03
0.04
0.05
NaOH Added (Wt. % Oil Sand)
$C^{o}_{SS}$
$C^{o}_{CS}$

MONITORING SURFACTANT CONTENT TO CONTROL HOT WATER PROCESS FOR TAR SAND

FIELD OF THE INVENTION

This invention relates to an improvement of the hot water process for extracting bitumen from tar sand ores. More particularly it relates to monitoring free surfactant concentration in the process water and using the obtained information to guide adjustment of the process, so as to maximize the production of primary bitumen froth.

BACKGROUND OF THE INVENTION

Tar sand, also known as oil sand and bituminous sand, is now well recognized as a valuable source of hydrocarbons. There are presently two large plants producing synthetic crude oil from the tar sands of the Athabasca region of Alberta. In these operations, the tar sands are first mined and the bitumen is then extracted from the ore by a process called the hot water process. The recovered bitumen is subsequently upgraded in a hydrotreating facility to produce the synthetic crude.

The physical nature of the Athabasca tar sand itself is what makes it amenable to the hot water process. More particularly, the tar sand is composed of bitumen, water, quartz sand and clays. The minute clay particles are contained in the water. The water forms a film around each sand grain. And the bitumen or oil is disposed in the interstices between the water-sheathed grains. Because the bitumen is in the water phase, it can be displaced from the sand grains by a water addition mechanism.

The first two steps of the hot water process, referred to as 'conditioning' and 'flooding', therefore are designed to aerate the slurry and disperse or increase the separation of the oil flecks away from the sand grains. A subsequent flotation/settling step is then applied to recover the oil and sand as separate products.

A "process aid" (commonly NaOH) is usually provided as an additive in the conditioning step. This process aid appears to react with groups associated with the bitumen molecules to form surfactants. In addition, there are naturally occurring surfactants present in discrete form in the tar sand. These various surfactants play an important role in facilitating successful dispersion and flotation of the oil.

The present invention is concerned with managing the process to ensure a favorable surfactant regime in the slurry.

The 'hot water process' will now be described in a general fashion. It is also disclosed in greater detail in the prior art literature and patents.

In the first step, 'conditioning', the as-mined tar sand is mixed with hot water (180° F.) and NaOH in a rotating horizontal drum. Steam is sparged into the drum contents at intervals along its length to ensure a slurry exit temperature of about 180° F. Typically, the amounts of reagents added are in the following proportions:

| | |
|---|---|
| tar sand | 3250 tons |
| hot water | 610 tons |
| NaOH | 4 tons (20% NaOH) |

The residence time in the drum is typically 4 minutes.

As previously stated, during conditioning the slurry is aerated in the course of being agitated and the solids and bitumen are dispersed in the aqueous phase.

The slurry leaving the drum is screened, to remove oversize material. The screened slurry is then 'flooded' by diluting it with a large dose of hot water. The flooded product typically comprises:

| | |
|---|---|
| bitumen | 7% by weight |
| water | 43% |
| solids | 50% |

The product temperature is typically 160°-180° F.

The diluted slurry then is transferred into a thickener-like flotation vessel, referred to as a 'primary separation vessel' ("PSV"). This open-topped vessel has a cylindrical upper end and a conical lower end.

The slurry is retained for a period of time in the PSV under quiescent conditions. Typically the retention time is about 45 minutes.

In the PSV, most of the sand sinks and is concentrated by the conical bottom to form a sand layer. This sand is discharged through a bottom outlet as an underflow. The discharge is discarded and is referred to as 'primary tailings'.

Much of the bitumen becomes attached to air bubbles and rises to form a layer of froth on the surface of the aqueous phase. This froth, referred to as "primary froth", overflows into a launder and is separately recovered.

| | |
|---|---|
| bitumen | 66.4% by weight |
| solids | 8.9% |
| water | 24.7% |

Not all of the bitumen is sufficiently buoyant to rise into the primary froth layer. Much of this non-buoyant bitumen, together with a large part of the clays, forms an aqueous suspension between the sand and froth layers. This suspension is referred to as "middlings". The water phase of the suspension can be referred to as "process water".

A stream of middlings is withdrawn from the vessel and is fed into sub-aerated flotation cells. In these cells, the middlings are subjected to vigorous agitation and aeration. Bitumen froth, termed "secondary froth", is produced and recovered. This secondary froth typically comprises:

| | |
|---|---|
| bitumen | 23.8% by weight |
| solids | 17.5% |
| water | 58.7% |

It will be noted that the secondary froth is considerably more contaminated with water and solids than the primary froth.

Before being forwarded on to the upgrading operation, it is necessary to remove most of the solids and water from the bitumen. This cleaning procedure is carried out in two stages of centrifugation. However, the secondary froth is not as easy to clean as the primary froth.

For this and other reasons, it is highly desirable in the management of the hot water process to maximize the production of primary froth and to minimize the production of secondary froth.

It is well understood in the industry that the tar sand feed varies significantly in nature. These changes in tar sand nature have a dramatic impact on the proportion of the contained bitumen that is recovered and whether recovered bitumen reports as primary froth or secondary froth. Factors which affect the nature of the tar sand include:

the relative proportions of bitumen, water, and "fines" (i.e. solids which pass through a 325 mesh screen) in the feed;

the extent of "weathering" or aging of the ore, which occurs after it is mined but before it is processed; and the circumstances under which the particular species of tar sand was laid down.

Some tar sands are referred to as "rich"—they typically contain 12–14% (w/w) bitumen and a relatively low fines content. Others are referred to as "lean"—they typically contain 6–9% bitumen and a relatively high fines content. Sample compositions are given in Table I.

TABLE I

| Oil Sand | Bitumen (% w/w) | Water (% w/w) | Solids (% w/w) | Fines (% w/w) |
|---|---|---|---|---|
| rich | 14 | 1 | 85 | 14 |
| average | 11 | 3 | 86 | 19 |
| lean | 6 | 11 | 83 | 21 |

Generally stated, rich tar sands process easily, giving a high recovery of relatively clean bitumen. Lean tar sands process poorly, giving a low recovery of relatively dirty bitumen.

In summary then, it is always a prime objective of a hot water process operator to manage the process so as to maximize recovery and to ensure that the greatest possible proportion of the bitumen recovered is in the form of primary froth. But his efforts in this direction are often interfered with by the variations in the nature of the tar sand feed.

In our U.S. Pat. No. 4,462,892 and in our paper entitled "The influence of natural surfactant concentration on the hot water process for recovering bitumen from the Athabasca oil sands", AOSTRA J. Research, 1 (1984) 5, (incorporated herewith by reference), we disclosed a process for better managing the hot water process. In these references, it was disclosed:

that there was a connection between free surfactant concentration in the process water and primary froth recovery;

more particularly, it was taught that if one monitored the "free" surfactant concentration in the process water when a single tar sand feed was processed at different levels of NaOH addition (all other conditions being constant), and if one plotted carboxylate-type free surfactant concentrations against primary froth recovery, a peak-like curve (referred to as a "processibility curve") was developed; and that if one repeated this procedure in the same circuit using different tar sand feeds, the various processibility curves developed all yielded their peak at substantially the same free surfactant concentration.

Stated otherwise, primary froth oil recoveries were observed to pass through a distinct maximum as a function of the equilibrium free carboxylate-type surfactant concentration in the process water. And the maximum oil recoveries were associated with a single valued critical equilibrium free surfactant concentration, which critical value would hold for a wide variety of types of oil sand when treated in that particular circuit.

(By "free" surfactant is meant those surfactant moities in solution and not bound up at interfaces. By "extraction circuit" is meant the conditioning drum, PSV and connecting piping.)

Thus, for a given circuit, an operator can establish the critical equilibrium free surfactant concentration ("$C_{cs}^o$") by making several runs with a single feed at varying NaOH additions; he can then monitor the equilibrium free surfactant concentration ("$C_{cs}$") in the process water for various tar sands fed to the process; and he can adjust the NaOH addition (as well as other process parameters such as water addition) to bring $C_{cs}$ to $C_{cs}^o$ and thereby maximize primary froth production.

The equilibrium free surfactant concentration in a sample of process water can be established by a method described in our paper entitled "A surface-tension method for the determination of anionic surfactants in hot water processing of Athabasca oil sands", published in Colloids and Surfaces, 11 (1984), 247–263. This paper is incorporated herewith by reference.

The mining of tar sands involves excavating a trench nearly 5 km in length and hundreds of feet in depth. The excavating equipment moves along the face of the trench and gradually increases the width of the trench. In the course of making a pass along the trench, many quite different varieties of tar sand are mined. For the majority of these ores, the process set forth in U.S. Pat. No. 4,462,892 is satisfactory. More particularly, with these ores the quantity of NaOH addition can be adjusted within a reasonably narrow range to bring $C_{cs}$ equal to $C_{cs}^o$ and maximum primary froth production will be attained.

However, it has been found that there are certain pockets of tar sand ore that do not initially appear to be most advantageously processed by practicing the process of U.S. Pat. No. 4,462,892. These ores, referred to as 'anomalous ores', have been found to give very poor primary froth recoveries when processed in accordance with U.S. Pat. No. 4,462,892.

An examination of the compositions of these anomalous ores did not give any useful guidance as to what might be done to improve bitumen recovery from them. When NaOH addition was varied within the commonly used range for the circuit, little or no improvement was noted.

There was therefore a need for an understanding of what was affecting the process and causing the poor recoveries with respect to these anomalous ores—and there was a further need for a means for overcoming the difficulty and modifying the extraction process to make it work well when treating them.

SUMMARY OF THE INVENTION

The present invention is based on the following observations and discoveries:

(1) that when tar sand is conditioned and diluted, there are actually two distinct classes of anionic surfactants, of importance to the process, that are likely to be produced and to be present in the process water. These are:

a first class of surfactants that appear to originate from carboxylate groups; and a second class, more polar in nature, that appear to originate from sulfonate groups;

(2) that each of these two classes of surfactants has the potential to dominantly influence (relative to the other class) the maximizing of primary froth production by the hot water process;

(3) that it is possible to establish for a circuit the critical equilibrium concentration of free surfactant in the process water for each of the two classes of surfactants; and (4) that it is possible to test to determine which of the two classes of surfactant will first (that is, at lowest process aid addition) dominate when a particular tar sand feed is being processed.

With these items in mind, an improvement has been developed that enables one to operate the hot water process at maximum primary bitumen froth recovery, whether the ore being treated is an anomalous ore (in which case the sulfonate-type surfactants dominate at low process aid addition) or a normal ore (in which case only the carboxylate-type surfactants dominate).

The improvement involves:

determining a measure of the critical equilibrium free surfactant concentration value for the circuit for the carboxylate-type surfactants (which value is hereafter referred to as "$C_{cs}^o$");

determining a measure of the critical equilibrium free surfactant concentration value for the circuit for the sulfonate-type surfactants (which value is hereafter referred to as "$C_{ss}^o$");

determining for the ore currently being treated whether the carboxylate-type or the sulfonate-type surfactants first predominantly influence the maximum primary froth recovery at low process aid addition;

and then adjusting process aid addition to the hot water process so as to bring the concentration of the dominating class of surfactants toward the critical concentration thereof.

DESCRIPTION OF THE DRAWINGS

FIG. 5(*a*) is a plot showing a typical NaOH/processibility curve for the 'normal' average grade estuarine tar sand ore of Tables I and II, treated in the BEU;

FIG. 5(*b*) is a plot showing the free surfactant concentrations in the process water when the ore used to develop FIG. 5(*a*) was treated at varying NaOH additions—the concentrations of carboxylate-type surfactants are identified by •'s and the concentrations of sulfonate-type surfactants are identified by 's—the critical free surfactant concentrations ($C_{cs}^o$ and $C_{ss}^o$) for the ore when treated in the BEU are shown as the broken lines;

FIG. 6(*a*) is a plot showing a typical NaOH/processibility curve for the 'anomalous' average grade channel margin tar sand ore of Tables I and II, treated in the BEU;

FIG. 6(*b*) is a plot showing the free surfactant concentrations in the process water when the ore used to develop FIG. 6(*a*) was treated at varying NaOH additions the concentrations of carboxylate—type surfactants are identified by •'s and the concentrations of sulfonate-type surfactants are identified by 's—the critical free surfactant concentrations $C_{cs}^o$ and $C_{ss}^o$, for the ore when treated in the BEU, are shown as the broken lines;

DESCRIPTION OF THE PREFERRED EMBODIMENT

Figure 1:
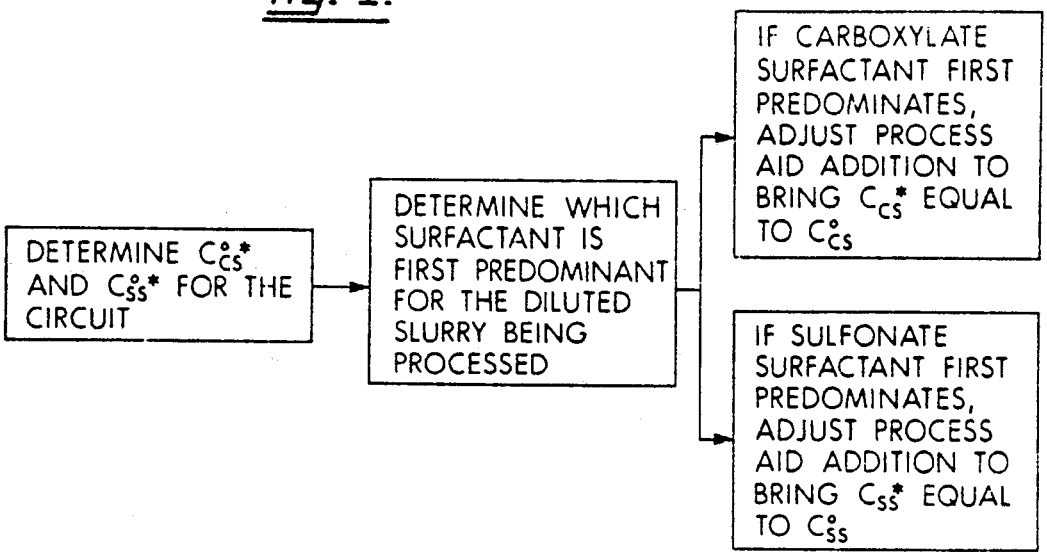
FIG. 1 is a block diagram showing the steps of the method.

Three separate hot water process circuits of varying size are operated by the present assignee. The largest is a commercial production unit, which operates at a rate of about 13,000 tons/hr. of tar sand. The middle unit is a continuous pilot circuit, which operates at a rate of about 2,270 kg/hr. And the smallest unit is a batch extraction unit (BEU) which operates on 500 g charges of tar sand.

The data underlying the present invention and presented herein was generated by use of the BEU, with verification of the BEU results in the pilot unit. The pilot unit has been shown to give hot water process results that conform with the results obtained from the commercial unit.

The BEU and its method of use is described by E. C. Sanford and F. A. Seyer in a paper entitled "Processability of Athabasca tar sand using a batch extraction unit: The role of NaOH", CIM Bulletin, 72 (1979) 164. This paper is incorporated herewith by reference. In general, the unit involves a steel pot having agitator and sub-aeration means. The procedure practised in its use involves:

slurrying 500 g tar sand with 150 g water and the desired amount of NaOH (0 to 0.24 wt. % tar sand) at 82° C.;

stirring with air sparging for 10 minutes (to simulate 'conditioning');

ceasing air sparging and adding 900 g water (to simulate 'flooding');

gentle stirring for 10 minutes (to simulate retention and flotation in the PSV);

collecting primary froth;

stirring with air sparging for 5 minutes (to simulate secondary recovery); and collecting secondary froth.

Samples collected from each extraction were assayed for oil, water and solids content by standard methods set forth in the book "Syncrude analytical methods for oil sand and bitumen processing", published by the Alberta Oil Sands Technology and Research Authority (August , 1979).

The concentrations for both the carboxylate-type and sulfonate-type surfactants in the process water were determined using the surface-tension method previously mentioned. The process water used for analysis purposes was the aqueous residue from the secondary recovery step in the BEU process.

The first class of surfactants appears to have originated from carboxylate-functional groups or precursors in the oil. The second class appears to have originated from sulfonate-functional groups or precursors in the oil. This classification is based on acid titrations and infra red spectroscopic measurements. The investigation of the detailed chemical nature and structure of the surfactants is presently at a preliminary stage—the specific chemical composition of these compounds is not important to the present invention.

Several oil sands feedstocks of differing nature were used in the work underlying the invention. The compositions of the feedstocks are set forth below in Table I. Note that a "rich" ore was taken to contain about 12–14% (w/w) bitumen, an "average" ore about 10–11% , and a "lean" ore about 6–9%.

TABLE I

Compositions of Oil Sands Studied

| Oil Sand (deposition type) | Grade | (% w/w) Bitumen | Water | Solids | Fines |
|---|---|---|---|---|---|
| Estuarine | Average | 11.5 | 4.2 | 84.2 | 17.5 |
| Channel Margin | Average | 11.4 | 3.4 | 85.6 | 26.3 |
| Marine | Average | 10.6 | 2.7 | 86.8 | 28.6 |
| Marine | Lean | 8.1 | 6.0 | 85.9 | 20.0 |
| Estuarine #1 | Rich | 13.2 | 1.1 | 85.5 | 6.2 |
| Estuarine #2 | Rich | 14.0 | 1.2 | 84.8 | 13.9 |

*The fines level is defined as the weight fraction of solids smaller than 44 μm and is expressed as a percentage of total solids.

As previously stated, we determined surfactant concentrations ($C_{ss}$ and $C_{cs}$) using the surface tension method described in the *Colloids and Surfaces* paper previously identified.

Figure 2:
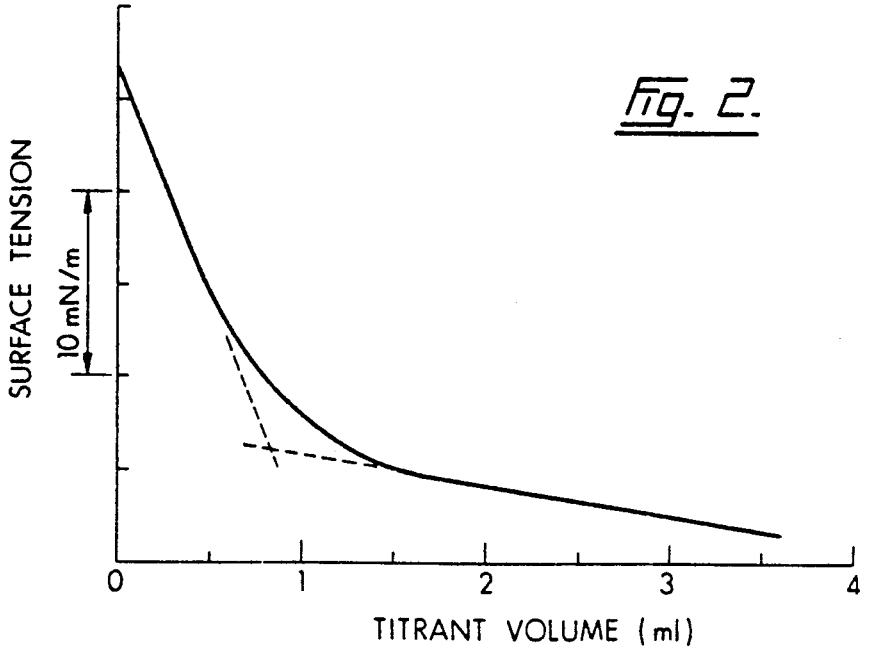
FIG. 2 is a plot showing a typical surface-tension-monitored CETAB titration curve for a solution containing carboxylate-type or sulfonate-type surfactant.
Figure 4:
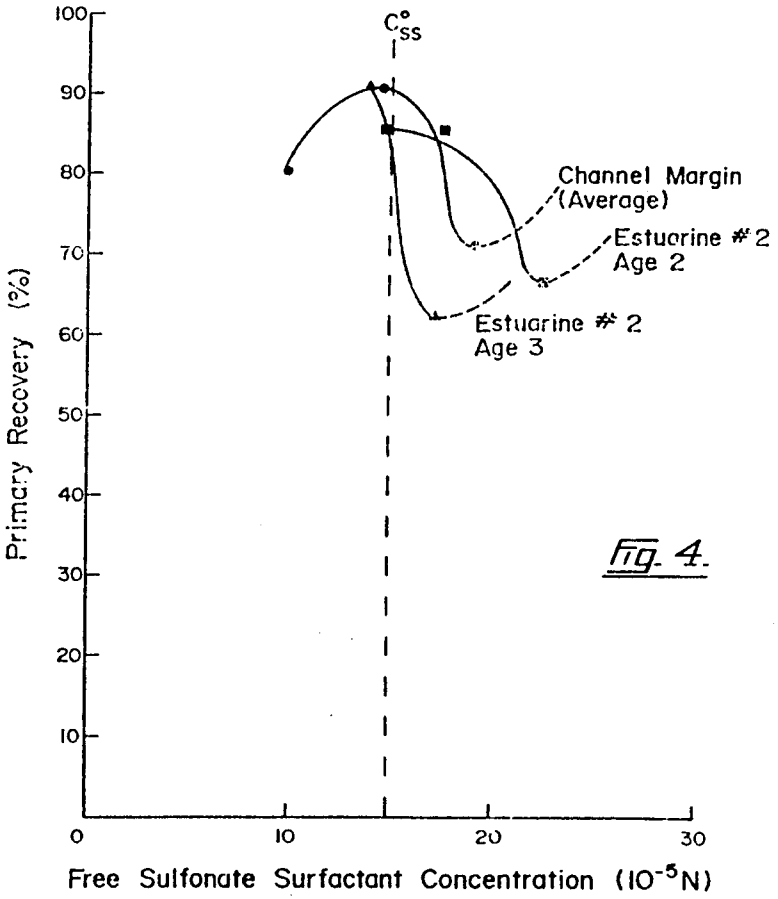
FIG. 4 is a plot of a plurality of surfactant/processibility curves developed from data obtained by extracting several 'anomalous' ores, identified and described in Tables I and II, under the same conditions in the BEU—the critical free sulfonate surfactant concentration $C_{ss}^o$ is established by the common value at which the peaks of the curves substantially coincide.

In short, this procedure involves measuring surface tension to monitor the course of surfactant titrations in which the total anionic surfactants are titrated with a known cationic surfactant. The cationic is added to tie up the anionic until there are no more free surfactants and the surface tension versus cationic added relationship changes (see FIG. 2). By conducting these titrations at low and high pH conditions, the carboxylate and sulphonate surfactants can be distinguished.

More particularly, samples of process water were first centrifuged at 15,000 g , to remove suspended solids. The supernatant solutions were then assayed for surfactants as follows.

The titration of a sample was carried out in aqueous solution and monitored by surface tension measurements. A titrant solution of cetyltrimethylammonium bromide ("CETAB"), 99% pure, having a strength of $5.00\times10^{-3}$ M, was used. A cell arrangement, as shown in the *Colloids and Surfaces* paper, was utilized.

Surface tension was measured with a surface tensiometer (SensaDyne Model 5000, Chem-Dyne Research Corp., Madison, Wis.). This instrument operates on the maximum bubble-pressure principle. A differential pressure is measured for nitrogen gas slowly bubbled through two immersed glass tubes of different internal radii.

A sample aliquot (20 ml) of centrifuged process water was diluted to 50 ml with deionized water and titrated with CETAB in 0.2 ml increments. A time lapse of up to three minutes was allowed between CETAB increments, particularly near the endpoint. For each CETAB increment the surface tension was measured.

This procedure was applied if only a single anionic surfactant was present or if a mixture of anionic surfactants in a sample was involved.

When present in a mixture, the carboxylate-type ("C-type") and sulfonate-type ("S-type") surfactant concentrations ("$C_{cs}$" and "$C_{ss}$") were determined separately as follows.

Only two titrations are required. The sample is first adjusted to pH 3.0 and filtered. One aliquot of the filtrate is titrated to yield $C_{ss}$. A second aliquot is readjusted to its original pH and titrated to yield ($C_{cs}+C_{ss}$). The C-type surfactant concentration can then be calculated from equation (1):

$$C_{cs}=(C_{cs}+C_{ss})-C_{ss} \quad (1)$$

It will be understood that the maximum bubble-pressure technique is a dynamic surface-tension method. In order to determine "static" surface tension, it must be ascertained that equilibrium is reached between the bubble surfaces and the solution. In this work, a bubble rate of 28 seconds per bubble (at each sensor probe) was found to adequately yield equilibrium or static surface-tension values. For purely analytical purposes, relative (dynamic) surface tensions are sufficient and the bubble rate can be increased to speed up the method.

The titration curves can take several different forms—however for purposes of the present invention, the titration curve is normally of one form. The curve shown in FIG. 2 was obtained from the titration of sodium laurate alone (that is, the curve is typical of a solution containing only a known carboxylate-type surfactant). Curves obtained from the titration of process water containing S-type surfactants are similar in form.

It will be noted that the surface tension decreases as the cationic-anionic compound is formed. The new compound is apparently more surface active than is the anionic surfactant. Beyond the equivalence point the surface tension is still lowered, but to a lesser extent, as free cationic surfactant appears in solution.

In the course of the work underlying the present invention, we used plots to develop what are referred to as "processibility curves". More specifically, we subjected a single tar sand feed to batch extractions in the BEU at standard conditions, but at varying NaOH additions. In conjunction with these runs, we monitored primary froth recovery, $C_{cs}$ and $C_{ss}$. With the resulting data in hand, we plotted NaOH addition against primary froth recovery to yield a NaOH/processibility curve; and we plotted free surfactant concentration against primary froth recovery to yield a surfactant/-processibility curve.

In U.S. Pat. No. 4,462,892 it was disclosed that, for the 'normal' or usual tar sand ore, the NaOH/processibility curve has a peak-like form. This is illustrated in FIG. 5(*a*) and supported in the data of Table II, for an average grade estuarine ore. It will be noted that some NaOH addition (0.04 wt. % oil sand) is required to yield a maximum primary froth recovery of about 97%. At higher additions, recovery drops.

Figure 3:
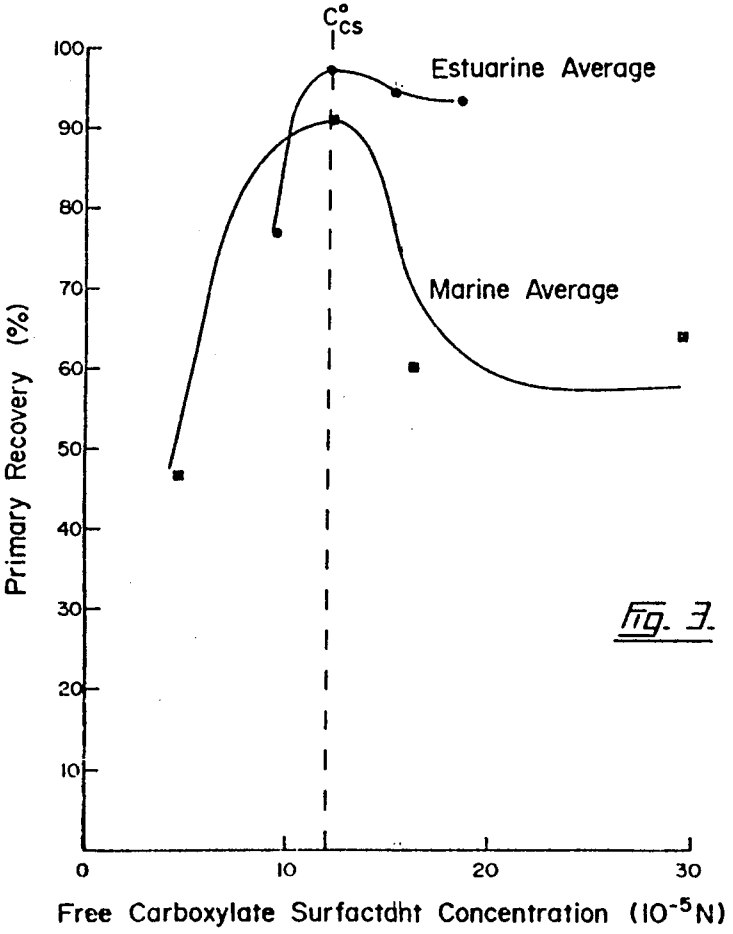
FIG. 3 is a plot of a plurality of surfactant/processibility curves developed from data obtained by extracting several 'normal' ores under the same conditions in a laboratory batch extraction unit ("BEU"), one such ore being the average grade estuarine ore of Tables I and II, the other ore being the marine average ore of said Tables—the critical free carboxylate-type surfactant concentration $C_{cs}^o$ is established by the common value at which the peaks of the curves substantially coincide.

As further disclosed in U.S. Pat. No. 4,462,892, if one runs a number of normal tar sands through a circuit, such as the BEU, at varying NaOH additions, and plots C-type surfactant/processibility curves from the run data, it is found that the curves have their maximum values generally at a common value (referred to as the 'critical' value). This is illustrated in FIG. 3.

However, in the work underlying U.S. Pat. No. 4,462,892, only those surfactants having an ascertainable effect on the primary froth recovery were monitored. These were only the C-type surfactants, as only normal ores were being worked with. Ores which did not perform in a normal fashion in the commercial plant were not encountered in the work underlying U.S. Pat. No. 4,462,892, prior to the present work.

In the present case, when an anomalous ore was tested carefully in both the BEU and pilot unit over a wide range of NaOH additions, it was discovered that the NaOH/processibility curve had two peaks or recovery maxima, with an intervening valley where primary froth recoveries were very poor.

This was demonstrated by the processing behaviour of an average grade channel margin tar sand (Table I). The supporting data for the runs are set forth in Table II. The data from the runs are plotted in the form of NaOH/processibility curves shown in FIG. 6(*a*) for the BEU and FIG. 7(*a*) for the continuous pilot unit.

FIGS. 6(*b*) and 7(*b*) show the free C-type and S-type concentrations generated in the process water during said runs at varying NaOH additions.

Comparison of FIGS. 6(*b*) and 7(*b*) with FIGS. 6(*a*) and 7(*a*) shows that the first or low NaOH addition recovery peak substantially coincides with $C_{ss}^o$. As this critical value is exceeded, the recovery declines. However, when recovery is down to about 70%, the C-type surfactant concentration begins to rise toward $C_{cs}^o$. As the C-type surfactant concentration approaches $C_{cs}^o$, a new peak primary froth recovery is reached.

It will be noted that the higher of the two maxima is due to the S-type surfactants and represents a primary froth recovery of about 90%. The second maxima, at a higher NaOH addition, is due to the C-type surfactants and represents a recovery of about 80%. In between the maxima, at an NaOH addition of 0.04%, the recovery drops as low as 20%.

Figure 7A:
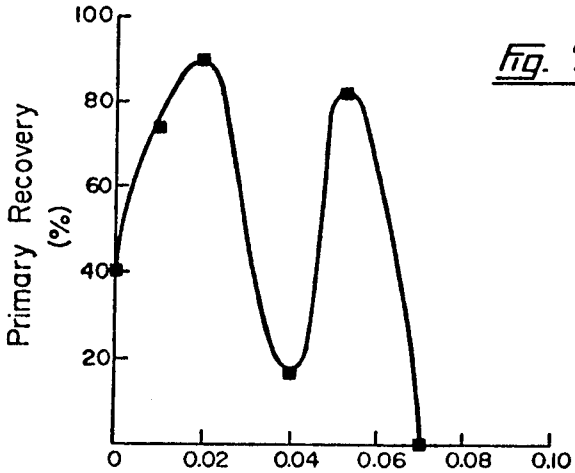
FIGS. 7(*a*) and 7(*b*) are plots of the same type as those of FIGS. 6(*a*) and 6(*b*) for the same tar sand, but the processing was carried out in the continuous pilot unit.
Figure 7B:
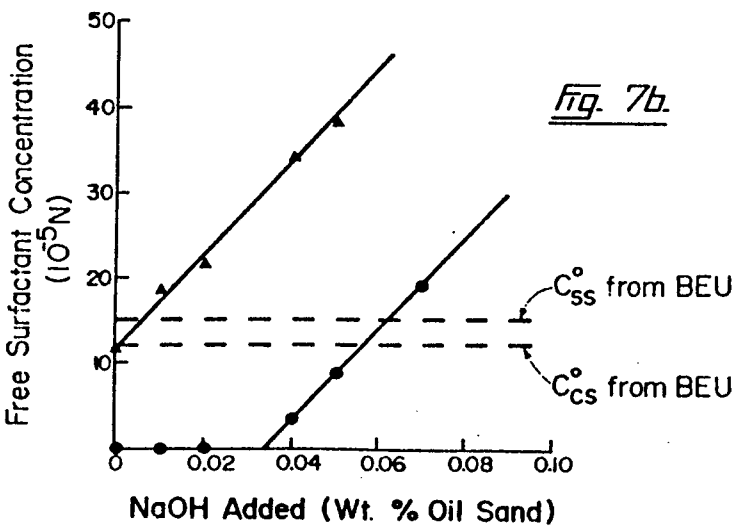

In summary, FIGS. 6 and 7 indicate that the two recovery peaks for the anomalous ore correspond individually to the action of the S-type surfactants and C-type surfactants respectively.

It is to be noted from FIGS. 6 and 7 that, for the anomalous ore, the concentration of free C-type surfactants in the process water is zero when the curve is extrapolated to zero NaOH. And the concentration of S-type surfactants in the process water at zero NaOH addition is close to $C_{ss}^o$.

The rules governing the present improvement therefore can be stated as follows:

the C-type surfactants control primary froth recovery when they are present in solution at concentrations near $C_{cs}^o$, no matter what the concentration of S-type surfactants;

the S-type surfactants control primary froth recovery when they are present in concentrations near $C_{ss}^o$, but only if the C-type surfactants are either absent or present at very low concentrations; and interference results if the S-type surfactants are present at concentrations near $C_{ss}^o$ while the C-type surfactants are present at significant concentrations but substantially less than $C_{cs}^o$.

It is possible to illustrate all these effects for a single tar sand, if 'ageing' is taken into account. Ageing of tar sand refers to changes that occur in tar sand with time after it is mined from the natural deposit. The ageing process in some way reduces the concentration of free C-type surfactants that can be generated from an oil sand with a given amount of added NaOH.

Figure 8A:
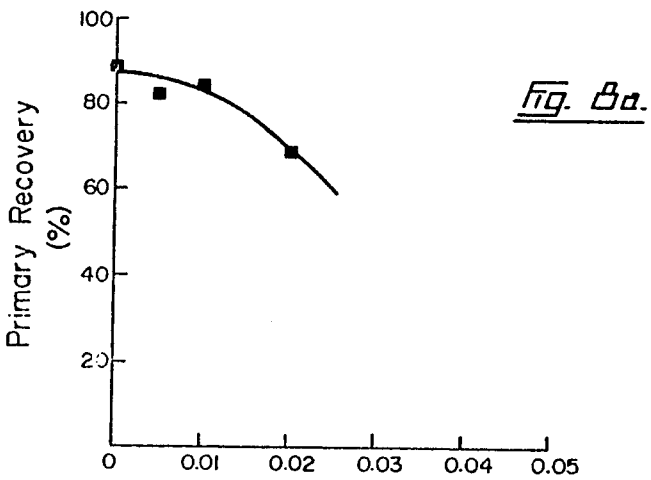
FIGS. 8*a*, 8*b*, 9*a*, 9*b*, 10*a*, 10*b*, 11*a* and 11*b* are plots of the same type as those of FIGS. 6(*a*) and 6(*b*), but showing the effects arising from increasing degrees of ageing.
Figure 8B:
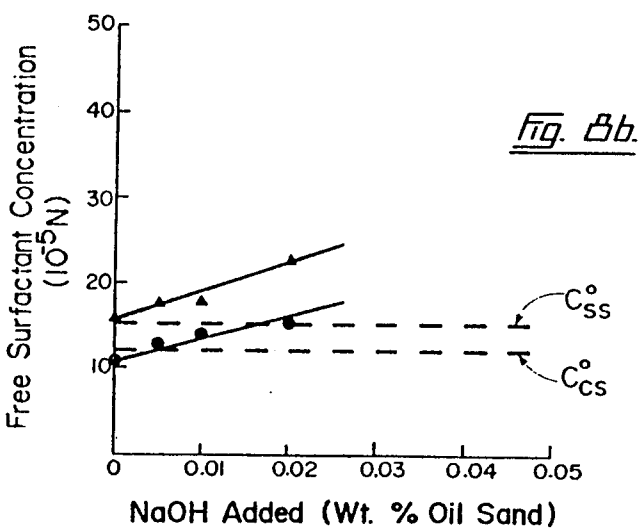

In this connection, the processibility of the rich estuarine #2 tar sand (Table I) was followed as it progressed through several arbitrary 'ages'. The process data are given in Table II. FIG. 8 shows the processibility of the fresh ore. Here, when no NaOH was added, both surfactant classes appeared at near their respective critical free concentrations. Accordingly, recovery was highest (89%) for the blank extraction.

Figure 9A:
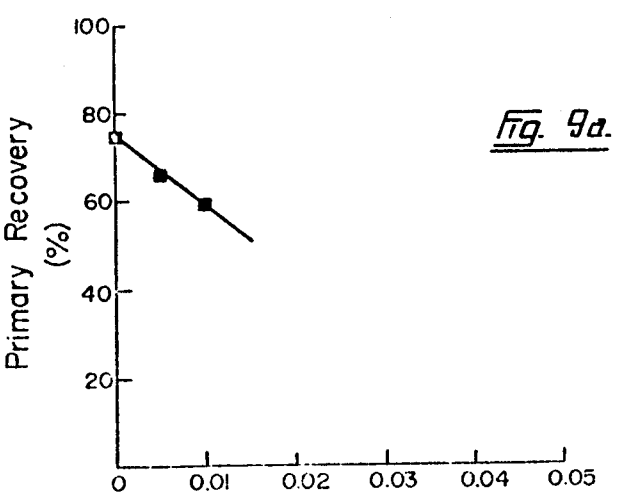
Figure 9B:
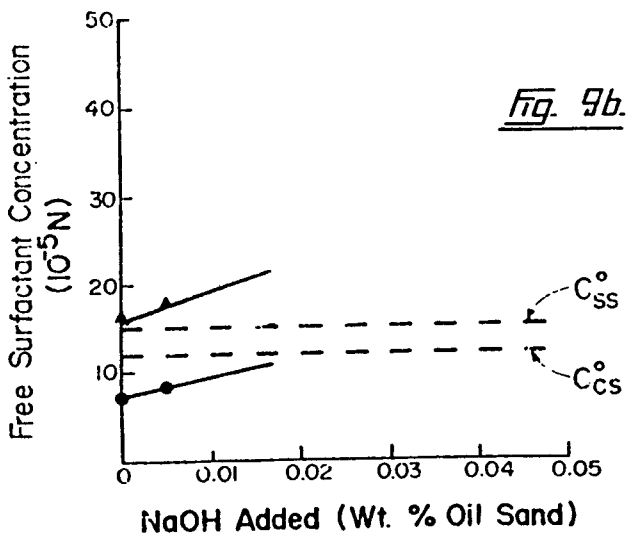

At 'age ', FIG. 9 shows that the free C-type surfactant concentrations decreased, while the free S-type surfactant concentrations remained relatively unaffected. It appears that while the S-type surfactant concentrations are still at about the critical value for a blank extraction, the reduced but still significant concentration of free C-type surfactants causes an interference which results in a primary recovery of only about 75% being obtained.

Figure 10A:
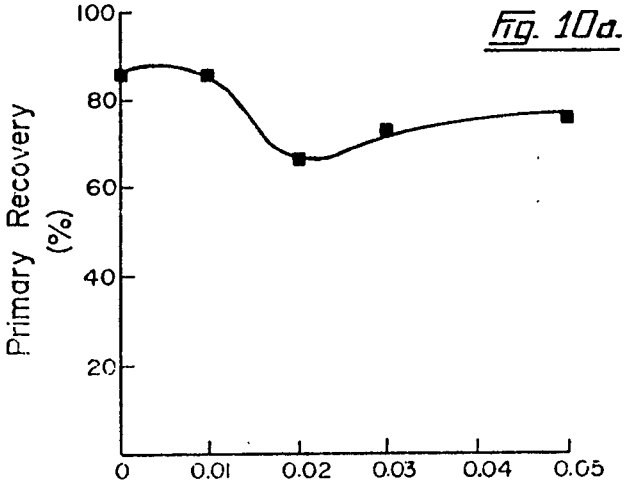
Figure 10B:
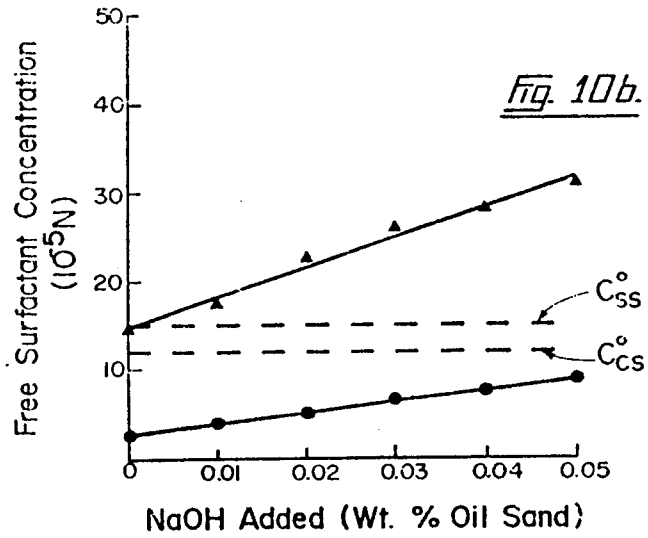

FIG. 10 shows that at 'age 2' the free C-type surfactant concentrations decreased still further, while the free S-type surfactant concentrations remained relatively unaffected at the critical value for a blank extraction. In this circumstance, the lower concentration of free C-type surfactants was associated with a somewhat restored primary recovery of about 86%. The improvement appears to be caused by less interference of the C-type surfactants with the action of the S-type surfactants. It can also be seen from FIG. 10 that at high NaOH addition levels (0.08 wt. % NaOH) primary recovery rose to a second peak as the free C-type surfactant concentration rose toward its critical level.

Figure 11A:
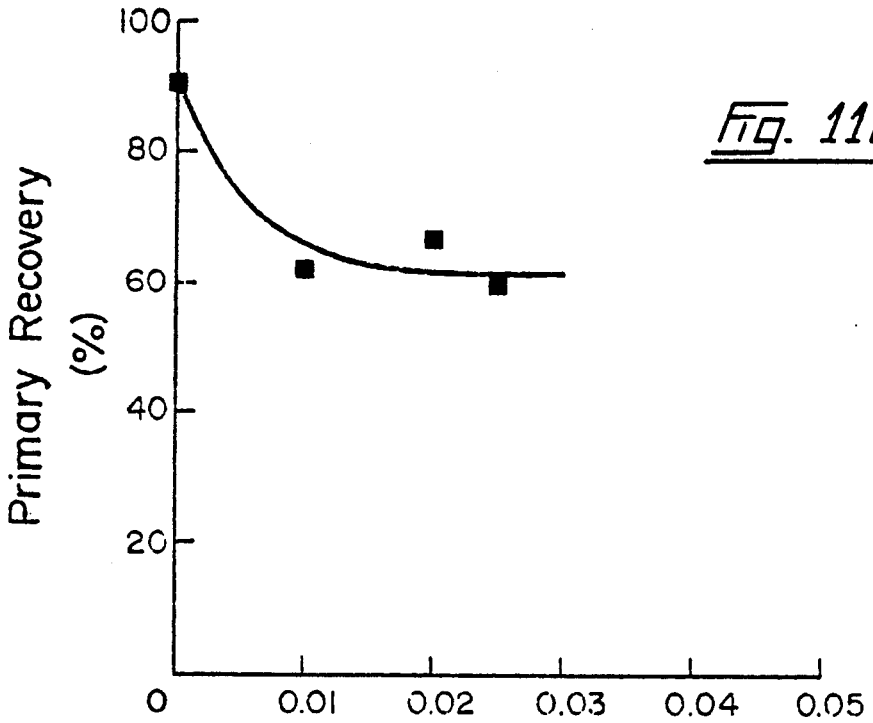
Figure 11B:
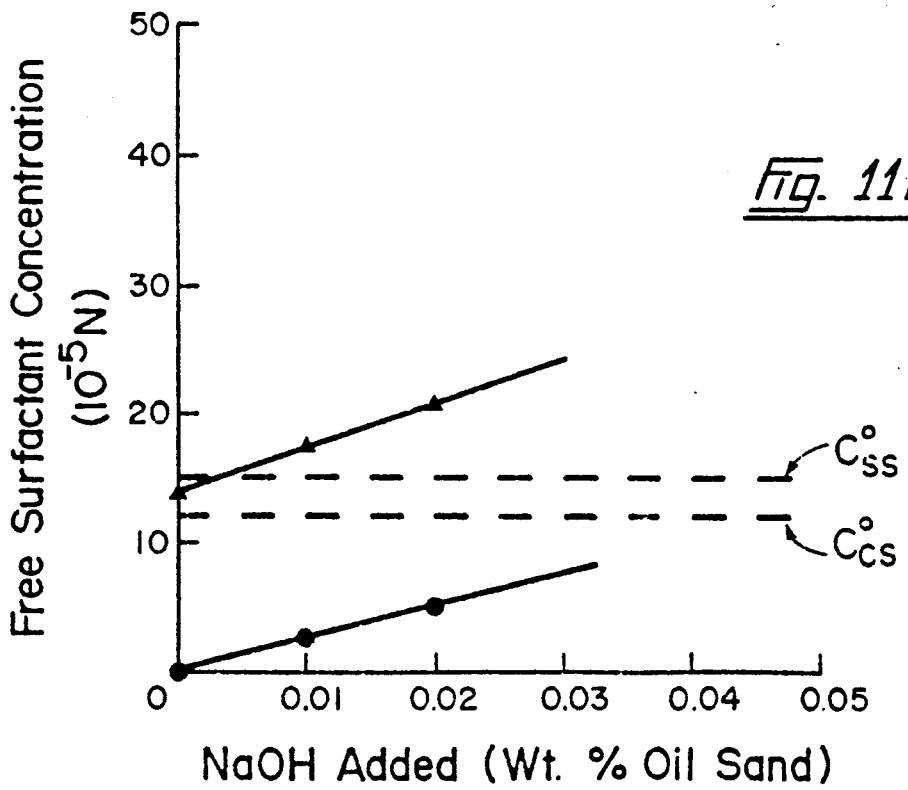

FIG. 11 shows that at 'age 3' the free C-type surfactant concentrations decreased yet further, while the free S-type surfactant concentrations remained again relatively unaffected at the critical level for a blank extraction. In this circumstance, the concentration of free C-type surfactants was zero and hence no interference by C-type surfactants with the action of the S-type surfactants was possible. As a result, a completely restored primary froth recovery of about 90% was obtained.

It will be noted from the (*b*) plots in FIGS. 8 through 11 that the free S-type surfactant concentrations, as function of NaOH addition, were almost invariant with 'age' of the tar sand. This is in marked contrast to the C-type surfactant concentrations, which decreased with tar sand age.

From the processibility behavior established, one can conclude that the S-type surfactants can efficiently operate the process, and there is a critical concentration $C_{ss}^o$ corresponding to maximum primary froth recovery. This parallelism with C-type surfactant behaviour leads to the suggestion that a similar mechanism is operative with the S-type surfactants as for the C-type surfactants. When the free C-type surfactant concentrations are near $C_{cs}^o$, primary froth recovery is maximized no matter what the concentration of S-type surfactants. When both classes of surfactants can pass through their respective critical concentrations, it is found that decreased recovery is obtained between $C_{ss}^o$ and $C_{cs}^o$. FIGS. 6(*a*), 7(*a*) and 10(*a*) show this. These results indicate some selectivity and interference effects. In the presence of S-type surfactants, the C-type surfactants appear to be preferentially adsorbed at the critical interfaces and mixed adsorption layers are apparently not effective in promoting bitumen recovery.

TABLE II

Oil Recovery and Measured Properties of Process Extracts from Batch Extractions of Oil Sands

| Oil Sand | Grade | NaOH Added (Wt. % Oil Sand) | Primary Oil Recovery (%) | Free Carboxylate Surfactant Concentration ($10^{-5}$ N) | Free Sulfonate Surfactant Concentration ($10^{-5}$ N) |
|---|---|---|---|---|---|
| Estuarine | Average | 0.02 | 76.8 | 9.4 | 24.4 |
| | | 0.04 | 97.4 | 11.7 | 32.0 |
| | | 0.06 | 94.6 | 15.2 | 40.6 |
| | | 0.08 | 93.5 | 18.6 | 47.9 |
| Channel margin | Average | 0.00 | 80.5 | 0.0 | 9.9 |
| | | 0.01 | 90.9 | 0.3 | 14.6 |
| | | 0.02 | 71.2 | 0.0 | 19.1 |
| | | 0.03 | 85.3 | 0.1 | 24.9 |
| | | 0.04 | 83.2 | 1.7 | 29.5 |
| | | 0.05 | 89.2 | 10.3 | 44.1 |
| | | 0.06 | 87.4 | 12.4 | 45.1 |
| | | 0.07 | 35.9 | 21.4 | 59.1 |
| Channel margin (continuous pilot process) | Average | 0.00 | 40.2 | 0.0 | 11.6 |
| | | 0.01 | 73.7 | 0.0 | 18.5 |
| | | 0.02 | 89.0 | 0.0 | 21.4 |
| | | 0.04 | 16.3 | 3.3 | 34.0 |
| | | 0.05 | 81.0 | 8.7 | 38.0 |
| | | 0.07 | 0.0 | 19.0 | 57.0 |
| Marine | Average | 0.04 | 46.6 | 4.6 | 75.1 |
| | | 0.08 | 91.0 | 12.1 | 86.0 |
| | | 0.12 | 60.1 | 16.2 | 116.3 |
| | | 0.16 | 64.1 | 29.8 | 156.4 |
| Marine added material | Lean | 0.10 | 6.3 | 1.0 | 160.6 |
| | | 0.13 | 32.7 | 6.3 | 198.1 |
| | | 0.16 | 48.9 | 10.6 | 233.5 |
| | | 0.20 | 44.8 | — | — |
| Estaurine #1 | Rich | 0.00 | 70.7 | 3.3 | 13.7 |
| | | 0.02 | 64.0 | 5.6 | 16.8 |
| | | 0.04 | 47.3 | — | — |
| Estuarine #2 Fresh | Rich | 0.00 | 88.0 | 10.4 | 15.3 |
| | | 0.005 | 81.9 | 12.7 | 17.4 |
| | | 0.01 | 83.7 | 13.8 | 17.5 |
| | | 0.02 | 68.5 | 15.1 | 22.5 |
| Age 1 | | 0.00 | 75.0 | 7.4 | 16.4 |
| | | 0.005 | 66.2 | 8.4 | 17.9 |
| | | 0.01 | 59.6 | — | — |
| Age 2 | | 0.00 | 85.5 | 2.7 | 14.7 |
| | | 0.01 | 85.6 | 4.1 | 17.5 |
| | | 0.02 | 66.6 | 5.0 | 22.5 |
| | | 0.03 | 72.6 | 6.7 | 25.9 |
| | | 0.04 | — | 7.6 | 28.2 |
| | | 0.05 | 75.5 | 8.9 | 31.1 |
| Age 3 | | 0.00 | 90.9 | 0.0 | 13.9 |
| | | 0.01 | 62.2 | 2.6 | 17.3 |
| | | 0.02 | 66.8 | 5.0 | 20.7 |
| | | 0.025 | 59.9 | — | — |

In a two-peak curve of the type illustrated in FIG. 7, it is possible that, for some ores, the second peak (maximum bitumen recovery due to carboxylate surfactant) could be higher than the first peak due to sulfonate. In such cases, it may be advantageous to operate the extraction process under either carboxylate or sulfonate control. Where the maximum recovery due to carboxylate is markedly higher, the cost of adding alkaline process aid required to reach this maximum may be more than offset by the extra bitumen obtained. It would thus be economically beneficial to ignore the first peak and operate under carboxylate control.

The embodiments of the invention in which an exclusive property or privilege is claimed are defined as follows:

1. In the hot water process for extracting bitumen from tar sand of varying nature in an extraction circuit, said process comprising conditioning the tar sand by slurrying it with hot water and alkaline process aid and agitating it, diluting the conditioned slurry with additional hot water, and retaining the diluted slurry in a primary separation vessel to produce an underflow of solids and an overflow of primary bitumen froth, the improvement comprising:

(a) determining for the circuit involved a measure of the critical equilibrium free carboxylate-type surfactant concentration ("$C_{cs}^{o}$"), in the process water, at which maximum primary froth recovery occurs;

(b) determining for the circuit involved a measure of the critical equilibrium free sulfonate-type surfactant concentration ("$C_{ss}^{o}$") in the process water, at which maximum primary froth recovery occurs;

(c) determining whether the diluted slurry undergoing processing is one from which recovery of primary froth is first predominantly influenced by the concentration in the process water of free carboxylate-type surfactants or free sulfonate-type surfactants;

(d) in the case where the carboxylate-type surfactants first dominate, adjusting process aid addition to the process to bring the equilibrium free carboxylate-type surfactant concentration in the process water toward $C_{cs}^{o}$;

(e) in the case where the sulfonate-type surfactants first dominate, adjusting process aid addition to the process to bring the equilibrium free sulfonate-type surfactant concentration in the process water toward $C_{ss}^{o}$;

and repeating steps (c), (d) and (e) on an on-going basis to establish a control method for maximizing primary froth recovery.

* * * * *